US006239698B1

(12) United States Patent
Porter et al.

(10) Patent No.: US 6,239,698 B1
(45) Date of Patent: May 29, 2001

(54) DETECTOR-ARRAY WITH MASK WARNING

(75) Inventors: Stephen George Porter; Bryan Lorrain Humphreys Wilson, both of Northants; Stephen Hollock, Lechlade, all of (GB)

(73) Assignee: Infrared Integrated Systems, Ltd.

( * ) Notice: Subject to any disclaimer, the term of this patent is extended or adjusted under 35 U.S.C. 154(b) by 0 days.

(21) Appl. No.: 09/351,467

(22) Filed: Jul. 12, 1999

(30) Foreign Application Priority Data

Jul. 14, 1998 (GB) ..... 9815273

(51) Int. Cl.[7] ..... G08B 29/00
(52) U.S. Cl. ..... 340/506
(58) Field of Search ..... 340/506, 571, 340/517, 521, 522, 526, 552, 553, 554, 555, 567

(56) References Cited

U.S. PATENT DOCUMENTS 5,499,016 * 3/1996 Pantus ..... 340/555

FOREIGN PATENT DOCUMENTS

| | | |
|---|---|---|
| 2308482 | 6/1977 | (GB) . |
| 2071641 | 9/1981 | (GB) . |
| 2117897 | 10/1983 | (GB) . |
| 2135769 | 9/1984 | (GB) . |
| 0481934 | 4/1992 | (GB) . |
| 0499177 | 8/1992 | (GB) . |
| 0507025 | 10/1992 | (GB) . |
| 0556898 | 8/1993 | (GB) . |
| 0772171 | 10/1996 | (GB) . |

* cited by examiner

*Primary Examiner*—Daryl Pope
(74) *Attorney, Agent, or Firm*—Malin, Haley & DiMaggio, P.A.

(57) ABSTRACT

When an array of thermal detectors with appropriate read-out means is used as a sensor to detect events such as intruders or fire, it may be disabled accidentally or deliberately by placing a mask over the array to shield it from the scene. The act of placing a mask over the array induces a simultaneous transient signal from all of the detectors, or at least a majority of the detectors, and is followed by a period when those detectors give rise only background noise or clutter. The characteristics of these signals is used to generate a warning signal to indicate that the sensor has been disabled.

7 Claims, 3 Drawing Sheets

DETECTOR-ARRAY WITH MASK WARNING

The present invention relates to sensors using detector arrays for identifying the occurrence of events. Such sensors have a variety of applications including flame detection and movement detection. Sensors designed for movement detection are used in security systems and simple examples are the well-known passive infra-red (PIR) intruder detectors. PIR devices detect movement and generate a corresponding alarm signal but they do not give any spatial information within their field of view. We have therefore proposed a sensor which comprises an array of detectors, preferably thermal detectors, with read-out means which monitor signals from each of the various detectors of the array independently and can then identify the occurrence of events by comparison of these signals. Such a sensor provides more information than known PIR devices but has the advantage of being simpler and cheaper to manufacture than known thermal imaging systems, in part because no thermal image is actually provided. A disadvantage of all PIR detectors is that if they are masked in some way, for example by covering them with fabric or by spraying paint over them, they cease to function. The present invention aims to enable the detection of such an event.

With a two dimensional array of thermal detectors, used without chopping the incident radiation, under normal conditions a scene would be focused onto the array and any thermal changes in each area of the scene would be focused onto the corresponding area of the array. With no thermal changes generated by movement or other activity in the scene, the output from the array would be limited to background noise or clutter.

In the event that an attempt was made to disable the sensor for example by covering the sensor with a mask such as a sheet of fabric, or such as paint sprayed across a viewing window, all or the majority of the detector elements would simultaneously detect a significant change in signal. This transient change would take place in the time taken to put the mask in place or the thermal time constant of the detector, whichever is the greater, and might be expected to lie between 0.1 and 10 seconds. Once the mask was in place there would only be background level noise or clutter from each detector. The reservation that not necessarily all but the majority of the detectors exhibit the simultaneous transient signal is made to allow for the coincidence that the temperature and emissivity of a part of the scene and of the mask may be such that no signal results from some of the detectors as the scene is replaced by the mask.

With the foregoing in mind the present invention provides a sensor comprising a two dimensional array of detectors and means for focusing radiation from a scene onto the array, read-out means for monitoring signals from all of the detectors, and means for generating a warning signal. A warning signal is generated in response to a change of signal from a majority of the detectors of the array occurring within a predetermined time period, said warning signal indicating masking of all or part of the sensor. In normal (unmasked) operation, signals from the detectors are monitored whereby to identify other events occurring within the scene.

The masking of a sensor would result in many or all of the detectors simultaneously producing a significant change in signal. This warning condition may be contrasted with the alarm signals generated by an intruder when adjacent elements of the array give successive signals as the intruder moves across the scene, or alarm signals generated by a fire when signals continue to be generated by one element and may spread to adjacent elements successively as the fire itself spreads.

Preferably the warning signal is generated when the signals from a majority of the detectors change by an amount above a predetermined threshold.

Bearing in mind that the masking would usually be followed by background noise only, preferably the warning signal is generated only when a signal within a predetermined time period from a majority of the detectors is followed by a period when these detectors produce only background noise or clutter below a predetermined background value.

It should be noted that the invention can also be used to provide a warning of partial masking if the sensor were to be disabled by a deliberately or inadvertently positioned obstruction. For example if the sensor is mounted in a warehouse it could be inadvertently "blinded" by a tall stack of pallets placed in front of it. In such applications it would again be necessary to specify signals above a threshold from a majority of the detectors, preferably followed by a period of only background noise or clutter from these detectors.

The "majority" may be a numerical majority, eg. more than 50 percent of the total number of detectors, or it may be a subset of the total number of detectors which are adjacent to each other and which cover an area which is larger than the typical "area" of an event to be detected. This latter approach takes account of the fact that a mask or obstruction would effect an area of adjacent detectors ie: a smaller array within the entire array.

Alternatively, a warning signal may be generated in response to a change in signal within a predetermined time period from a majority of detectors within a defined sub array of the sensor, ie. a smaller area within the entire array.

The majority may be defined as a large majority, eg 75 percent or more.

In preferred embodiments of this invention the detector array is formed of thermal, e.g. pyroelectric, detector elements, and is mounted directly onto a silicon integrated circuit which interrogates the output from each element.

An embodiment of the invention will now be described by way of example only and with reference to the accompanying drawings in which.

Figure 1:
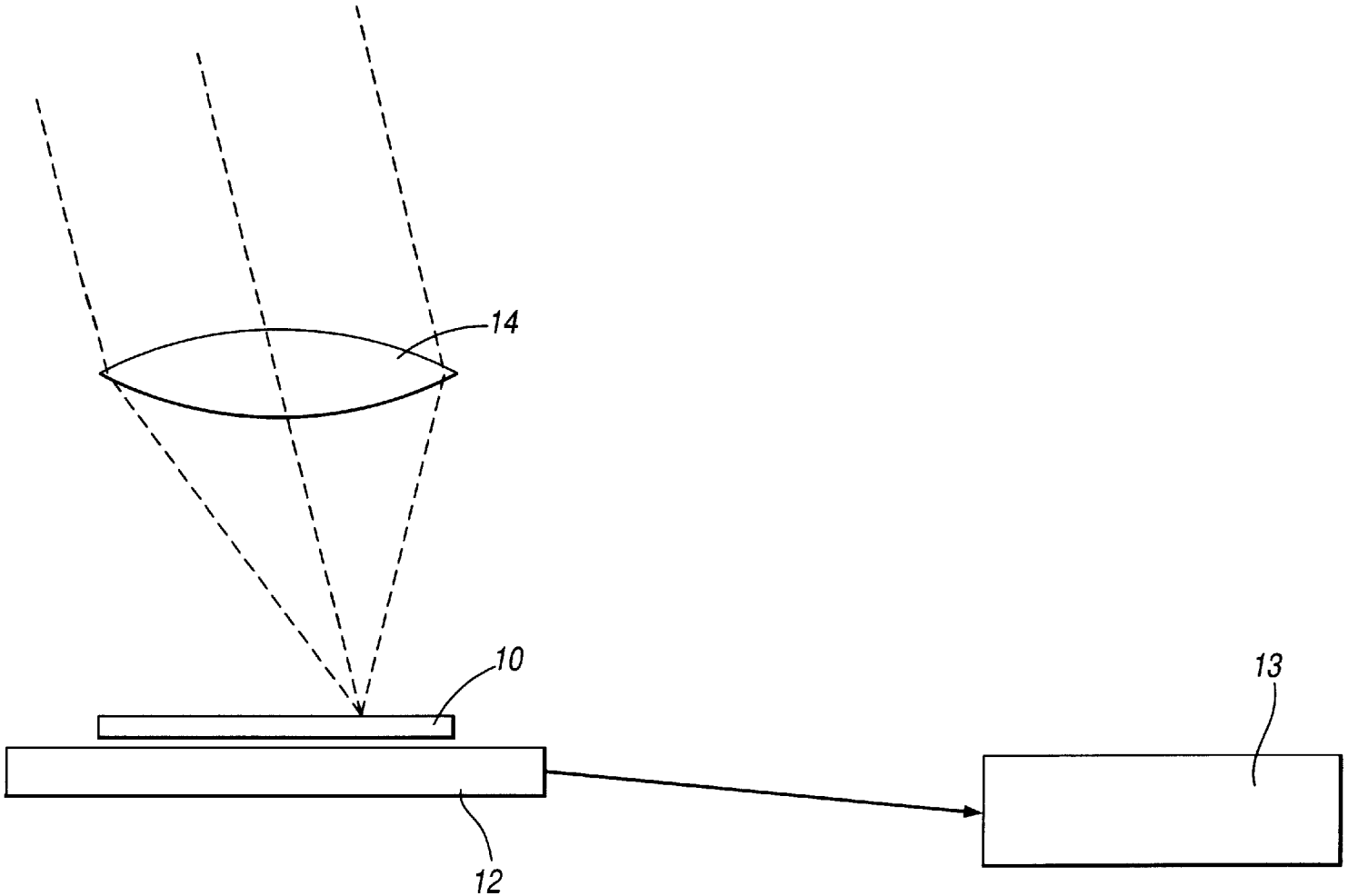
FIG. 1 is a schematic diagram of the basic components of a sensor which may embody the present invention.

FIG. 1 shows a rectangular array of pyroelectric elements 10 mounted on a silicon integrated circuit 12 which interrogates the signals from each of the detectors. The operation is controlled by a microprocessor 13. Radiation is focussed onto the array 10 by means of a lens 14.

Figure 2:
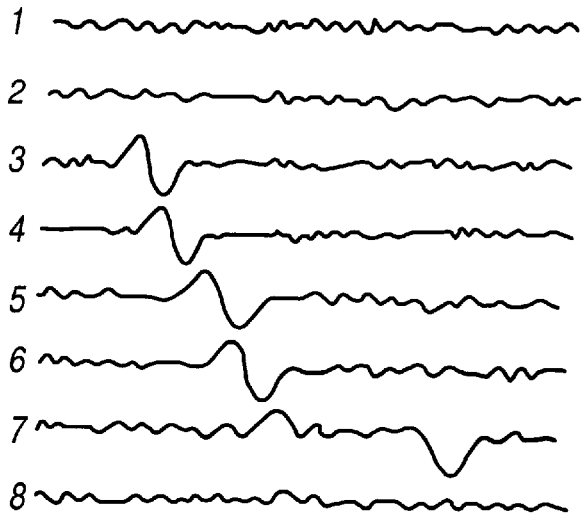
FIG. 2 shows schematically typical signals from a row of adjacent detectors in the sensor of FIG. 1.

FIG. 2 shows schematically signals from a row of adjacent detectors. All signals show background noise, but detectors 3 to 6 show a moving object which comes to rest while imaged on to detector 7 and then moves away again. This illustrates the normal operation of the array.

Figure 3:
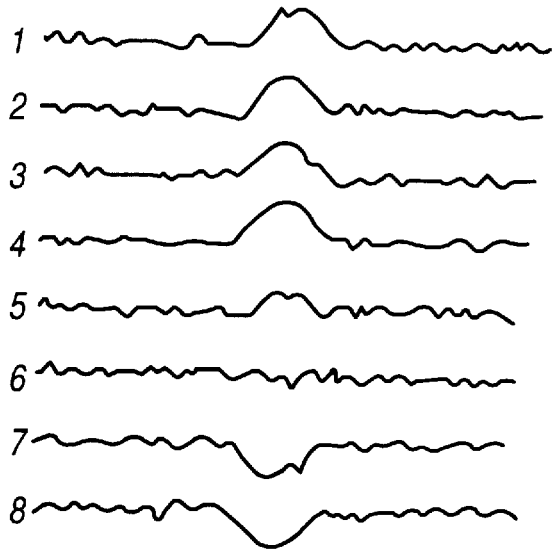
FIG. 3 shows schematically typical signals from a row of adjacent detectors which have been masked in some way.

FIG. 3 shows a different set of signals that might be associated with a mask being placed over the array. Elements 1 to 5 show positive signals, element 6 shows no signal discernible above the background and elements 7 and 8 show negative signals. The difference in sign of the signal corresponds to emission from the mask being greater or less than that from the area of the scene which is imaged, usually corresponding to the relevant temperature. All the signals occur at approximately the same time.

Figure 4:
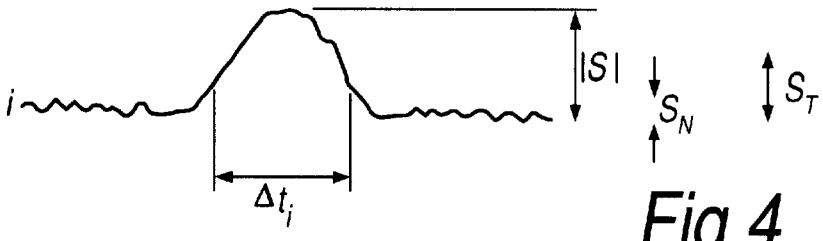
FIG. 4 illustrates a thresholding operation which may be used to discriminate between signals.

In this embodiment of the invention, the microprocessor analyses the signals from the detectors and generates a warning signal when the signals from a majority of the total number of detectors change by a minimum amount within a predetermined period. Thus, the microprocessor executes a thresholding and timing operation illustrated in FIG. 4. Any signal which undergoes a change in magnitude $|S|$ which is greater than a minimum amount $S_T$ is noted. The change in signal typically occurs within a time $\Delta t_i$ which may vary over the detectors in a specified group. To generate a warning signal a predetermined number of detectors must undergo a similar change within a time $\Delta T$ which is greater than the maximum value of $\Delta t_i$. Furthermore a "mask" warning is only generated if the change is followed by background noise less than a preset level $S_N$.

Figure 5:
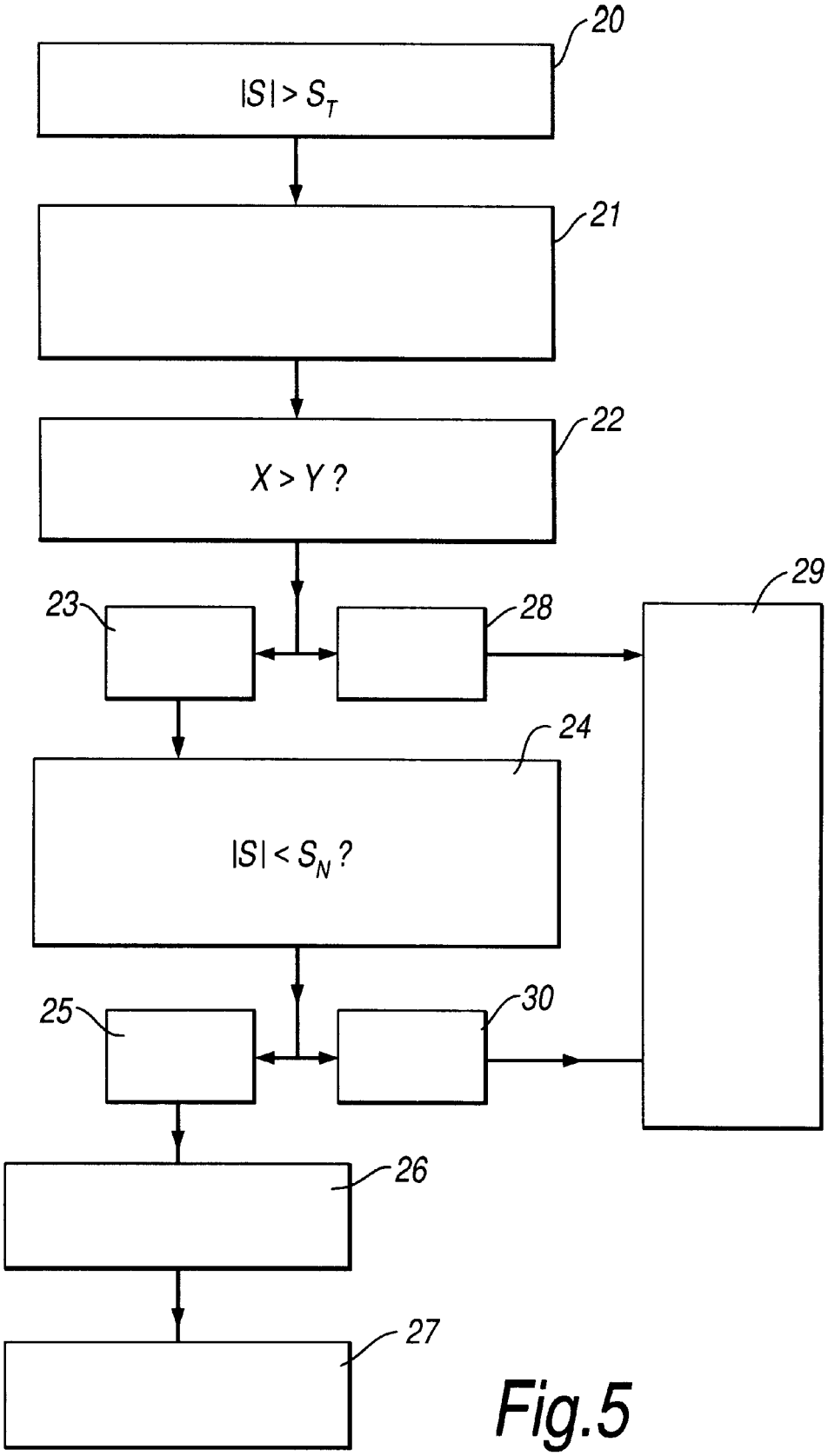
FIG. 5 is a flow diagram illustrating the process of detecting when a mask has been put in place and issuing a warning signal.

FIG. 5 is a flow diagram which shows the process of detecting when a mask has been put in place and issuing a warning signal. The Steps of FIG. 5 are as follows:

At step 20, a signal change $|S|>S_T$ is obtained from one detector. At step 21, a determination is made as to how many detectors show a transient signal change $|S|>S_T$ within a predetermined interval $\Delta T$. At step 22 a decision is made as to whether the number X calculated at step 21 is greater than a predetermined number Y. The number will be determined for the sensor in question based on the number of detectors in the array. If X>Y (step 23) it is then determined at step 24 whether, during a further predetermined observation period $T_0$ the detectors show only background noise or clutter $|S|<S_N$. In the affirmative (step 25) masking is identified at step 26 and a warning signal is generated at step 27.

If $X \leqq Y$ (step 28) or if $|S| \geqq S_N$ (step 30) this is an indication of a possibly significant event in normal operation of the sensor and at step 29 the signals are handed over to be analysed in the normal way according to the intended function of the sensor.

Referring to FIG. 5, circuits to discriminate signals which are above or below a given threshold are well-known and may use analogue techniques or follow analogue to digital conversion. Other functions may be accomplished using well-known digital techniques.

What is claimed is:

1. A sensor comprising a two dimensional array of detectors and means for focusing radiation from a scene onto the array, read-out means for monitoring signals from all of the detectors, and means for generating a warning signal wherein a warning signal is generated only in response to a change of signal by a minimum amount from a majority of the detectors within a predetermined time period, said warning signal indicating masking of all or part of the sensor, and signals from the detectors are monitored whereby to identify other events occurring within a scene.

2. A sensor as claimed in claim 1, in which the warning signal is generated only when the change in signal from said majority of the detectors is followed by a period when those detectors only generate background noise or clutter.

3. A sensor as claimed in claim 1, in which the thermal detector array is an array of thermal detectors.

4. A sensor as claimed in claim 3, in which the thermal detector array is mounted on a silicon integrated circuit, which forms all or a part of the read-out means.

5. A sensor as claimed in claim 3, in which the array is an array of pyroelectric detectors.

6. A method of operating a sensor comprising an array of detectors and means for focussing radiation from a scene onto the array, the method comprising generating a warning signal only in response to when signals from a majority of the detectors in the array change by a minimum amount within a predetermined time period, said warning signal indicating masking of all or part of the sensor; and monitoring signals from the detectors whereby to identify other events within the scene.

7. A method of operating a sensor comprising an array of detectors and means for focussing radiation from a scene onto the array, the method comprising generating a warning signal only in response to a change in signal from a majority of the detectors of the array occuring within a predetermined time period followed by a period of background noise or clutter in the said majority of the detectors, said warning signal indicating masking of all or part of the sensor; and monitoring signals from the detectors whereby to identify other events within the scene.

* * * * *